US005842285A

United States Patent [19]

van der Veen

[11] Patent Number: 5,842,285

[45] Date of Patent: Dec. 1, 1998

[54] GAS-FIRED DRYING APPARATUS

[75] Inventor: Geuko van der Veen, Deventer, Netherlands

[73] Assignee: Gastec N.V., Apeldoorn, Netherlands

[21] Appl. No.: 544,170

[22] Filed: Oct. 17, 1995

[30] Foreign Application Priority Data

Oct. 18, 1994 [NL] Netherlands ..... 9401723

[51] Int. Cl.[6] ..... F23D 3/40

[52] U.S. Cl. ..... 34/108; 431/326

[58] Field of Search ..... 34/124, 125, 444, 34/454, 108; 165/90; 432/105, 107; 431/326

[56] References Cited

U.S. PATENT DOCUMENTS

| | | | |
|---|---|---|---|
| 2,603,457 | 7/1952 | Bishop | 257/95 |
| 2,984,472 | 5/1961 | Marks | 263/6 |
| 2,987,305 | 5/1961 | Calhoun, Jr. | 432/31 |
| 3,150,864 | 9/1964 | Fetner et al. | 432/31 |
| 3,492,741 | 2/1970 | Witworth | 34/124 |
| 3,643,344 | 2/1972 | Strube | 34/124 |
| 3,675,337 | 7/1972 | Daane | 34/124 |
| 3,729,180 | 4/1973 | Bourrel et al. | 34/124 |
| 3,840,337 | 10/1974 | Heise | 432/105 |
| 4,304,985 | 12/1981 | Miller | 219/216 |
| 4,688,335 | 8/1987 | Krill et al. | 34/41 |
| 4,796,525 | 1/1989 | Schiel et al. | 100/93 |
| 5,152,685 | 10/1992 | Coulon | 431/326 |
| 5,553,391 | 9/1996 | Bakalar | 34/110 |

FOREIGN PATENT DOCUMENTS

| | | |
|---|---|---|
| 752823 | 7/1956 | United Kingdom . |
| WO9007680 | 7/1990 | WIPO . |

*Primary Examiner*—Henry A. Bennett
*Assistant Examiner*—Pamela A. O'Connor
*Attorney, Agent, or Firm*—Weingarten, Schurgin, Gagnebin & Hayes LLP

[57] ABSTRACT

A drying apparatus comprising a cylindrical drum (1) for drying, on the outside surface of the drum (1), pulp-shaped and viscous substances, such as for instance coffee milk powder, or band-shaped products, such as for instance paper, cardboard or textile, the apparatus comprising means for heating the drum (1) from the inner space of the drum (1), the means for heating the drum from the inner space of the drum (1) comprising a number of gas burners (2) juxtaposed in axial direction of the drum and controllable independently of one another. In furher elaboration of the invention, the gas burners are radiant burners.

9 Claims, 2 Drawing Sheets

GAS-FIRED DRYING APPARATUS

Figure 1:
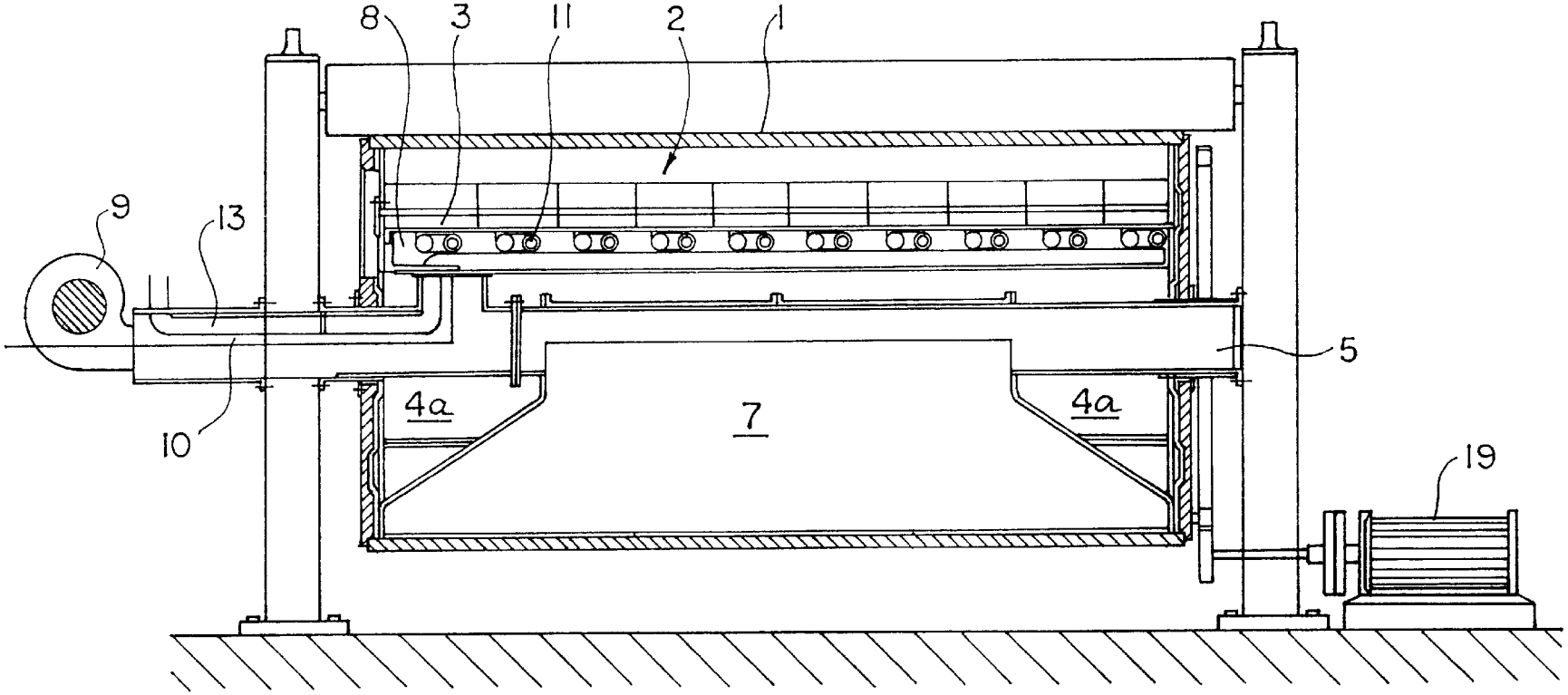

The invention relates to an apparatus for drying products.

Such an apparatus is known from U.S. Pat. No. 2,987,305. The drawback of this known apparatus is that the cylindrical drum is uniformly heated throughout its length. After all, the burner of the known drying apparatus, which burner extends substantially throughout the length of the cylindrical drum, has the same, non-variable capacity about the entire length of the drum. However, in many cases there is a need to vary the heat distribution over the length of the drum. This is for instance the case when the product to be dried does not dry uniformly throughout the length of the drum, for instance as a consequence of a difference in thickness of the product layer fed.

In practice, drying apparatuses are typically used wherein the interior of the drum is heated by means of steam. When such known apparatus is used for drying pulp-shaped and viscous substances, such as for instance milk powder from thickened milk or thickened coffee milk, the drying apparatus is generally referred to by the term "roller dryer". Drying apparatuses which are used for drying band-shaped products, such as for instance paper, cardboard or textile, are in practice generally referred to by the term "cylinder dryer". The known roller and cylinder dryers comprise a cylindrical drum, on the outside surface of which the pulp-shaped and viscous substances or the band-shaped products are dried. The steam by means of which the drum of the apparatuses known from practice are generally heated condenses against the inside surface of the drum and transmits heat to the drum at that location.

Heating the drum by means of steam has the following drawbacks:

- In the first place, a high investment is necessary for the steam supply, such as for instance a boiler house, a steam boiler and a steam and condensate pipe system.
- During the production of steam and the transportation thereof, 30–50% of the energy supplied with the fuel is lost.
- The production capacity of the drying apparatus is limited by the maximum steam pressure allowable in the drum, which steam pressure also determines the temperature of the steam, and accordingly the production capacity.
- In view of the safety standards that have to be observed for equipment involving steam pressure, the drum should have a great wall thickness, which leads to a high weight, as a result of which the frame supporting the drum should also be of a heavy design, which again leads to a high floor load. Moreover, the great wall thickness of the drum has as a consequence that the heat transmission through the drum wall is adversely affected.
- As the drum is heated with steam and the entire drum is filled with steam, the drum wall is heated to the same extent throughout.

By virtue of the use of gas burners for heating the inside surface of the drum, compared with the steam-heated drying apparatuses, the proposal from U.S. Pat. No. 2,987,305 has as a result that no provisions are required anymore for generating steam and processing condensate. Through the use of gas burners for heating the drum, the drying apparatus is given a considerably higher efficiency than the efficiency attainable with a roller or cylinder dryer functioning on the basis of steam. Moreover, the wall thickness of the drum can be considerably smaller, because no steam pressure prevails within the drum. This smaller wall thickness reduces the loss of temperature occurring when the heat is transmitted from the inside surface to the outside surface. Further, the construction of the drying apparatus becomes considerably lighter, which has a favorable effect on the weight of the frame and on the structural provisions that have to be made in connection with the floor load of the drying apparatus.

Although the first four drawbacks of the steam-heated drums are removed by the proposal from U.S. Pat. No. 2,987,305, the fifth drawback is still present. As is already mentioned hereinabove in the discussion of U.S. Pat. No. 2,987,305, in many cases there is a need to vary the heat distribution over the length of the drum. After all, in the case of an uneven layer thickness of the material to be dried, a drum which is uniformly heated throughout its length involves the risk that the material to be dried is overheated at the location of the slight layer thickness and even burns, whereas at the location of the greater layer thickness the drying process is not rounded off completely.

The object of the invention is to provide a drying apparatus without the above-mentioned drawbacks.

As the heat supply to the drum can be varied over the length of the drum, it can be effected that the temperature distribution over the length of the drum proceeds according to a specific desired pattern. As is already mentioned in the discussion of the prior art, this is important inter alia if the product to be dried does not dry uniformly throughout the length of the drum, for instance as a consequence of a difference in thickness of the product layer fed.

By utilizing radiant burners having a radiant plate on which the combustion of the gas takes place, the flame is cooled by contacting the radiant plate, which minimizes the production of $NO_x$. Another advantage of the use of radiant burners is that the flames do not contact the drum wall, which prevents hot spots on the drum wall, which hot spots may cause an uneven drying of the product. Because of the high temperature of the radiant plate, a part of the heat produced during the combustion of the gas is transferred, via radiation, to the drum. This radiation-transferred heat results in a uniform heating of the drum.

As the means for heating the outside surface of the drum from the inner space of the drum do not only comprise burners but also a flue conducting element adapted to conduct flue gases coming from the gas burners along at least a part of the inside surface of the drum in tangential direction of that inside surface to a flue gas outlet, the heat released upon the combustion of the gas is not only transferred to the drum via radiation from the radiant plate, but the heat present in the flue gases is also transferred to the drum via convection. By virtue of this convective heat transfer, the efficiency of the drying apparatus is improved considerably.

Figure 2:
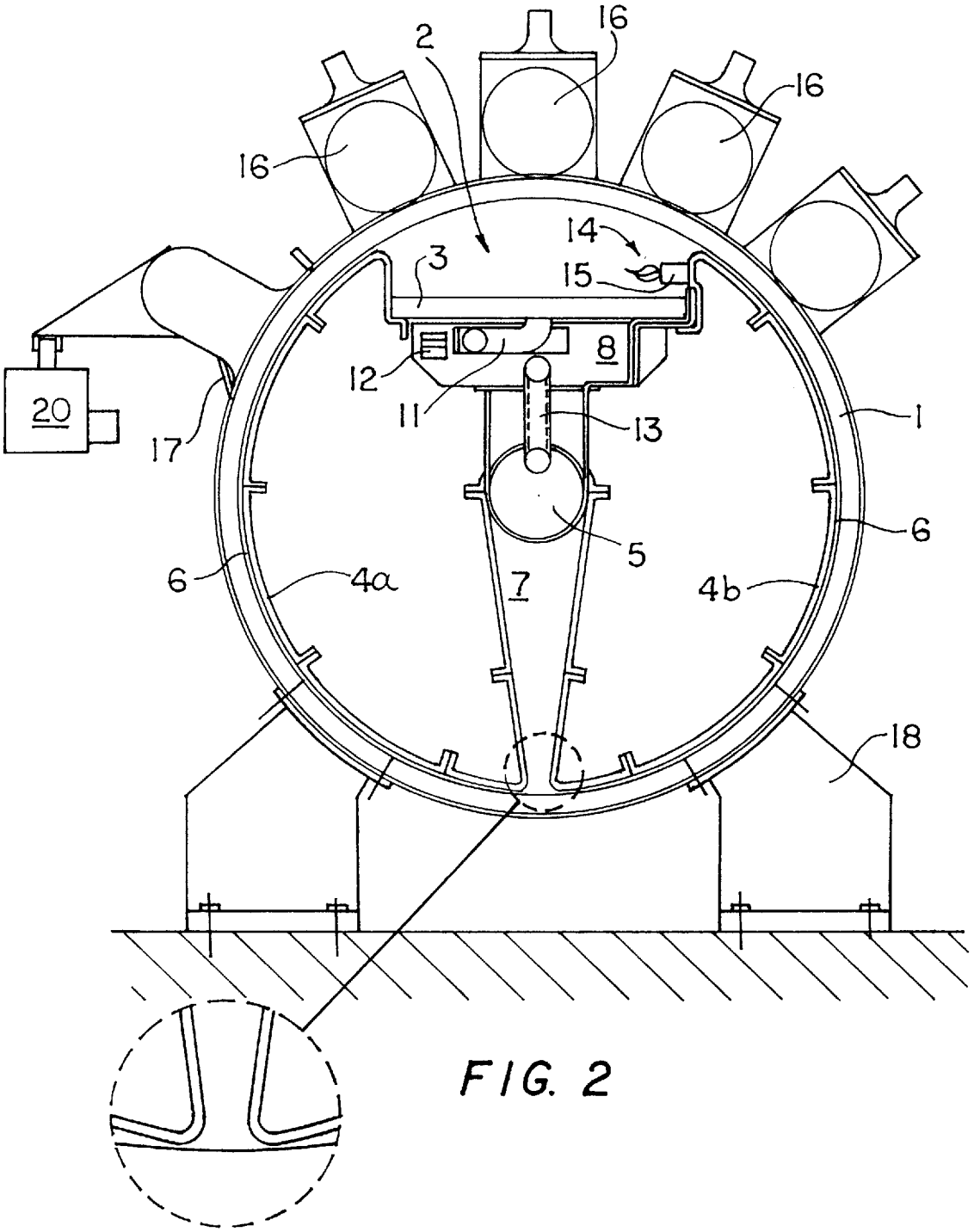

Further elaborations of the invention are set forth in the subclaims and will be specified hereinafter with reference to the accompanying drawings. In these drawings:

FIG. 1 is a longitudinal sectional view of an embodiment of the drying apparatus; and FIG. 2 is a cross-sectional view of the exemplary embodiment shown in FIG. 1.

The exemplary embodiment shown of a drying apparatus according to the invention is a roller dryer. In a roller dryer, which is used in particular for drying pulp-shaped or viscous products, the product to be dried is applied, by applicator rollers 16, on the outside surface of the roller 1 and the product is dried during a single revolution of the roller 1 to be scraped from the roller surface by a blade 17 at the end of this revolution. The roller 1 is rotatably supported by a frame 18 and is rotatably driven, via a transmission, by a motor 19. Directly after the dried product has been scraped from the drum, the temperature of the dried product is measured by an infrared sensor 20 displaceable along the drum surface. Depending on the temperature measured, the amount of heat supplied is regulated.

The heating principle according to the invention is also applicable to cylinder dryers which are employed in particular in the paper and textile industries. Cylinder dryers generally comprise a number of rotating cast-iron, hollow cylinders along which a band of textile or paper is passed. By a travelling drying felt, the textile or paper band to be dried is fixedly pressed on the ground outside surfaces of the cylinders.

As is observed hereinabove, the exemplary embodiment shown is a roller dryer wherein the roller 1 is referred to by the term "drum 1". The term "drum" has been chosen because it also includes the term "cylinder" of cylinder dryers, so that the following description could just as well refer to an exemplary embodiment of a cylinder dryer.

From the inner space of the drum 1, the drum 1 of the drying apparatus is heated by gas burners 2. The gas burners 2 are designed as radiant burners, comprising a radiant plate 3 against the surface of which the combustion of the gas takes place. The radiant plate 3 is arranged in such a manner that at least a part of the heat released through the combustion is transferred to the inside surface of the drum 1 via radiation. Disposed in the drum 1 is a flue conducting element consisting of two flue conducting plates 4*a*, 4*b*. The flue conducting plates 4*a*, 4*b* are substantially semi-cylindrical and have their cylindrical surfaces disposed in the inner space of the drum 1 so as to be substantially concentric relative to the drum 1. Between the flue conducting plates 4*a*, 4*b* and the inside surface of the drum 1, a narrow flue discharge slot 6 is present, terminating, on the side of the drum 1 diametrally opposite the gas burners 2, in a flue duct 7, which, in turn, terminates in a flue discharge tube 5. Through the flue discharge slot 6, the flue gases coming from the radiant burner 2 are conducted in tangential direction along the inside surface of the drum 1 to the flue duct 7.

Optionally, the flue conducting plates 4*a*, 4*b* can be positioned relative to the drum 1 so that the slot width of the flue discharge slot 6 decreases in the direction of the flue duct 7 so as to compensate the decrease in volume of the cooling flue gases, as a result of which the flow rate of the glue gases in the flue discharge slot 6 decreases less, if at all.

Viewed in longitudinal or axial direction of the drum 1, a number of gas burners 2 are juxtaposed. In the present exemplary embodiment, the gas burners 2 can be regulated independently of one another, so that the heat supply is variable over the length of the drum 1. Such variable heat supply brings about a variable change in temperature over the length of the drum 1, which can be advantageous in some uses, for instance when the layer thickness of the product to be dried is not equal throughout the length of the drum 1. For the sake of independent control, in the present exemplary embodiment, each gas burner 2 comprises an injector 11 having an electromagnetic valve 12, each injector 11 being connected to a single gas feed line 13. By means of a ventilating fan 9, the combustion air, required for the combustion, is blown through an air feed line 10 into a common air distribution chamber 8. The injectors 11 and the electromagnetic valves 12 are accommodated in the air distribution chamber 8, so that these parts are cooled by the combustion air flowing past. Since the combustion of the gas/air mixture takes place against the radiant plate 3, the flames are cooled by the radiant plate 3, which minimizes the formation of $NO_x$. The gas burners 2 are ignited by a pilot burner 14 connected to a separate gas line 15, the pilot burner 14 being electrically ignitable. Furthermore, the pilot burner 14 is electrically protected.

To increase the efficiency of the drying apparatus, the drum 1 can have its inside surface provided with a coating of a high emission and absorption coefficient, so that the heat transfer by radiation is improved.

Further, the internal surface of the drum 1 and of the flue conducting plate 4*a*, 4*b* can be provided with fins or grooves, so that the heat-absorbing surface of these parts is increased. As a result, the convective heat transfer from the flue gases to these parts is promoted, which also has a favorable effect on the efficiency of the drying apparatus.

When, in addition, the flue conducting plates 4*a*, 4*b* are manufactured from heat-resistant and insulating material, these flue conducting plates 4*a*, 4*b* reach a higher temperature than the drum 1, so that the radiation from the gas duct plates 4*a*, 4*b* contributes to the heating of the drum 1, which again improves the efficiency of the drying apparatus.

Because the drum 1 is not under pressure, as is the case with steam-heated drums, it can be of a light construction, as a further result of which the frame 18 can be of a light construction. In addition, the production capacity of the drying apparatus can be increased considerably due to the fact that a higher drum temperature can be worked with than the temperature attainable with a steam-heated drum.

It is understood that the invention is not limited to the exemplary embodiment described and that various modifications are possible within the purview of the invention. As mentioned hereinabove, the means for heating the drums may also be incorporated into the cylinders of the cylinder dryers.

I claim:

1. A drying apparatus for drying products chosen from the group consisting of pulp-shaped and viscous substances; and band-shaped products, the apparatus comprising:

a cylindrical drum on which the products are to be dried; and a plurality of gas burners disposed within the drum for heating the drum from the inner space of the drum said gas burners being controllable independently of one another, so that the heat supply is variable over the length of the drum; and at least one flue conducting element disposed in the drum, and adapted to conduct flue gases coming from the gas burners along at least a part of the inside surface of the drum in a tangential direction of said inside surface, to a flue gas outlet, wherein the flue conducting element comprises two substantially semi-cylindrical flue conducting plates disposed in the inner space of the drum so as to be substantially concentric relative to the drum, with a narrow flue discharge slot being present between the flue conducting plates and the inside surface of the drum, said flue discharge slot terminating, on the side of the drum diametrically opposite the gas burners, in a flue duct terminating in a flue discharge tube.

2. A drying apparatus according to claim 1, characterized in that the flue conducting plates are disposed relative to the drum so that the slot width of the flue discharge slot decreases in the direction of the flue duct.

3. A drying apparatus according to claim 1, characterized in that the flue conducting element is manufactured from heat-resistant, insulating material.

4. A drying apparatus according to claim 1, characterized in that:

the gas burners are radiant burners, each comprising a radiant plate against the surface of which the combustion of the gas takes place, said radiant plate being disposed in such a manner that at least a part of the heat released through the combustion is transferred to the inside surface of the drum via radiation;

the flue conducting plates are disposed relative to the drum so that the slot width of the flue discharge slot decreases in the direction of the flue duct;

the flue conducting element is manufactured from heat-resistant, insulating material;

the drum has its inside surface provided with a coating of a high emission and absorption coefficient;

the inside surface of the drum is provided with fins or grooves;

the inside surface of the flue conducting element is provided with fins or grooves;

via a common air distribution chamber, the gas burners are connected to an air feed line provided with a ventilating fan, each gas burner comprising an injector having an electromagnetic valve, each injector being connected to a gas feed line;

the injectors and the electromagnetic valves are accommodated in the air distribution chamber; and a pilot burner is disposed next to the gas burners and connected to a separate gas line, said pilot burner being electrically ignitable and protected.

5. A drying apparatus for drying products chosen from the group consisting of pulp-shaped and viscous substances; and band-shaped products, the apparatus comprising:

a cylindrical drum on which the products are to be dried;

a plurality of gas burners disposed within the drum for heating the drum from the inner space of the drum, said gas burners being controllable independently of one another, so that the heat supply is variable over the length of the drum;

at least one flue conducting element disposed in the drum, adapted to conduct flue gases coming from the gas burners along at least a part of the inside surface of the drum in a tangential direction of said inside surface, to a flue gas outlet, wherein the flue conducting element is manufactured from heat-resistant, insulating material.

6. A drying apparatus according to claims 1,5, characterized in that via a common air distribution chamber, the gas burners are connected to an air feed line provided with a ventilating fan, each gas burner comprising an injector having an electromagnetic valve, each injector being connected to a gas feed line.

7. A drying apparatus according to claims 1 or 5, characterized in that the inside surface of the drum and/or the flue conducting element is provided with fins and grooves.

8. A drying apparatus for drying products chosen from the group consisting of pulp-shaped and viscous substances; and band-shaped products, the apparatus comprising:

a cylindrical drum for drying, on the outside surface of the drum (1), pulp-shaped and viscous substances;

a plurality of gas burners disposed within the drum for heating the drum from the inner space of the drum said gas burners being controllable independently of one another, so that the heat supply is variable over the length of the drum; and a common air distribution chamber wherein the gas burners are connected to an air feed line provided with a ventilating fan, each gas burner comprising an injector having an electromagnetic valve, each injector being connected to a gas feed line, wherein the injectors and the electromagnetic valves are accommodated in the air distribution chamber.

9. A drying apparatus for drying products chosen from the group consisting of pulp-shaped and viscous substances and band-shaped products, the apparatus comprising:

a cylindrical drum on which the products are to be dried;

a plurality of gas burners disposed within the drum for heating the drum from the inner space of the drum, said gas burners being controllable independently of one another, so that the heat supply is variable over the length of the drum; and a pilot burner disposed next to the gas burners and connected to a separate gas line, said pilot burner being electrically ignitable and protected.

* * * * *